United States Patent [19]

Faiks

[11] 4,314,728

[45] Feb. 9, 1982

[54] CHAIR CONTROL

[75] Inventor: Frederick S. Faiks, Greenville, Mich.

[73] Assignee: Steelcase Inc., Grand Rapids, Mich.

[21] Appl. No.: 145,439

[22] Filed: May 1, 1980

[51] Int. Cl.[3] ..... A47C 3/00; A47C 1/00

[52] U.S. Cl. ..... 297/300; 297/353

[58] Field of Search ..... 297/300, 304, 353

[56] References Cited

U.S. PATENT DOCUMENTS

| | | | |
|---|---|---|---|
| 3,758,157 | 9/1973 | Fries | 297/300 |
| 3,881,772 | 5/1975 | Mohrman | 297/300 |
| 4,154,477 | 5/1979 | Swenson et al. | 297/353 |

*Primary Examiner*—Patrick D. Lawson

*Attorney, Agent, or Firm*—Price, Heneveld, Huizenga & Cooper

[57] ABSTRACT

The specification discloses a synchrotilt chair control in which a heavily loaded toggel linkage or slide arrangement between the rear of the seat support member and the chair back support member is eliminated by providing a slide and track arrangement between the front of the chair seat support and the front of the stationary housing. The front location is relatively lightly loaded as compared to the rear of a chair to which the control is mounted.

9 Claims, 14 Drawing Figures

CHAIR CONTROL

BACKGROUND OF THE INVENTION

The present invention relates to synchrotilt chair controls. In synchrotilt controls, the chair back and the chair seat both tilt, and generally tilt together, but they tilt at different rates. The back tilts at a faster rate so that as one tilts back, he is less likely to have his feet lifted off of the floor by the rising front edge of the chair seat. In contrast, the other two common types of chair controls include one attached to the chair seat only such that the chair and back tilt at the same rate or one attached to the back only such that the back tilts, but the seat doesn't.

Synchrotilt chair controls typically have a stationary member with a resilient biasing means mounted in the stationary member. A chair back support means is usually pivotally mounted on the stationary member and is operably interconnected with the resilient biasing means. A chair seat support means is mounted on the stationary member and is operably connected to the chair back support means for rearward tilting with the chair back support means, but at a different rate with respect to it.

In order to provide for the differential rate of tilting between the chair seat and back, the chair seat support and the chair back support portions of the control must move relative to one another. Yet, they must be interconnected to one another so that the relative movements of the chair seat and back can be coordinated.

One way that prior artisans have achieved this result is to provide a toggel linkage between the rear of the seat support and the rear of the back support. Examples of prior art patents disclosing such a mechanism include the following:

U.S. Pat. Nos. Lie 2,991,125, issued July 4, 1961; Dufton 3,369,840, issued Feb. 20, 1968; Williams 3,402,964, issued Sept. 24, 1968; Lie 3,455,601, issued July 15, 1969; Kerstholt 3,602,537, issued Aug. 31, 1971; and Williams 3,672,721, issued June 27, 1972.

Another alternative employed by prior artisans is to provide a sliding connection between the rear of the seat support and the rear of the back support member. Examples of this approach include U.S. Pat. Nos. Sengpiel 2,447,601, issued Aug. 24, 1948; Moore 3,072,436, issued Jan. 8, 1963; and Pauquete 4,013,257, issued Mar. 22, 1977.

There are two important drawbacks to these prior art arrangements. Perhaps most importantly, the moving toggel linkage or slide between the rear of the seat support member and the rear of the back support member are subjected to tremendous loading forces and accordingly tend to wear out and otherwise operate inefficiently. The tremendous forces imposed on the rear of a chair control, either a seat supporting member or a back upright supporting member or both, are perhaps not totally appreciated by those skilled in the art. Hence, the prior art devices described above have not enjoyed any significant success.

At least one prior artisan has attempted to overcome this difficulty through the use of two separate torsion members in an attempt to distribute the loading forces. Anderson et al, U.S. Pat. No. 3,545,810, issued Dec. 8, 1970. Even so, the loads imposed at the rear of the seat support member and back upright support member are very high. Further, such mechanisms tend to be extremely cumbersome and complicated, as do the prior art mechanisms described above.

Another problem encountered with the arrangements described above is that a user may get the feeling as he leans back that the chair back and seat are separating from one another due to the slight shift between the seat support member and the back support member at the rear thereof. One prior artisan attempted to eliminate this uneasy feeling by pivotally joining the rear of the seat support to the chair back support and providing for sliding movement at the point at which the back support members are pivotally joined to the stationary chair control housing. Ciuffini et al, U.S. Pat. No. 3,240,528, issued Mar. 15, 1966. Unfortunately, that also is a heavily loaded point and accordingly, there may be a tendency for the sliding bearings to stick or wear out.

SUMMARY OF THE INVENTION

In the present invention, the heavily loaded toggel arrangement or slide at the rear juncture of the chair seat support and chair back support is eliminated. Instead, the rear portion of the seat support and back support are directly pivotally connected. The stationary control housing includes a track located towards the front thereof and the chair seat support member is slidably mounted in the track at the front of the control mechanism.

This arrangement obviates the difficulties described above in that as a user leans rearwardly in a chair, he very heavily loads the rear of the chair but tends to decrease or minimize the loads at the front of the chair. Consequently, wear, tear and sticking of moving parts are minimized.

Further, because the rear portion of the seat support and back support are pivotally connected directly together and do not shift with respect to one another, there is less feeling that the chair seat and back are separating as the user leans back in the chair. These and other objects, advantages and features of the invention will become more fully understood and appreciated by reference to the written specification and appended drawings.

DESCRIPTION OF THE PREFERRED EMBODIMENT

Figure 1:
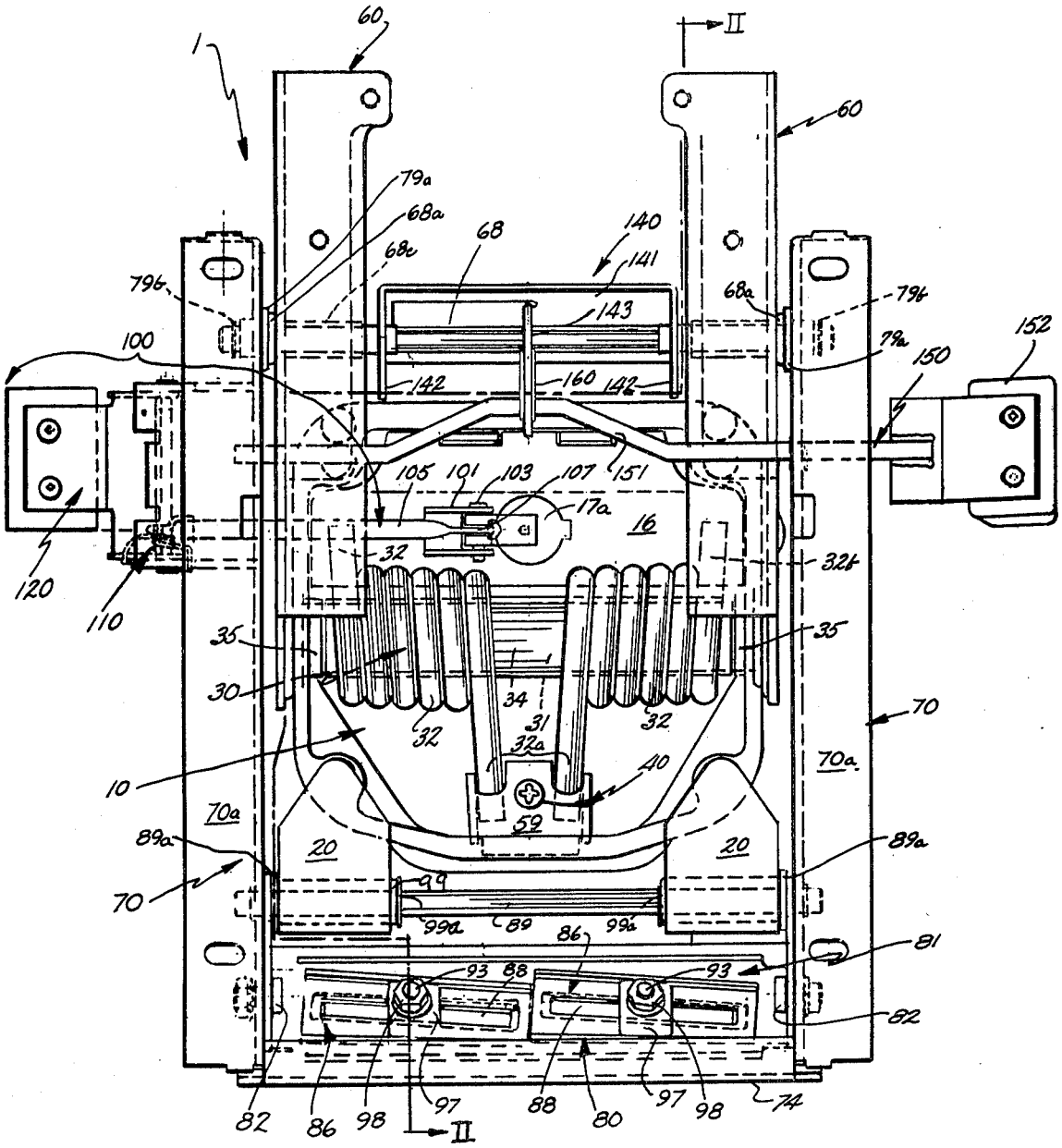
FIG. 1 is a plan view of a chair control made in accordance with the present invention.
Figure 4:
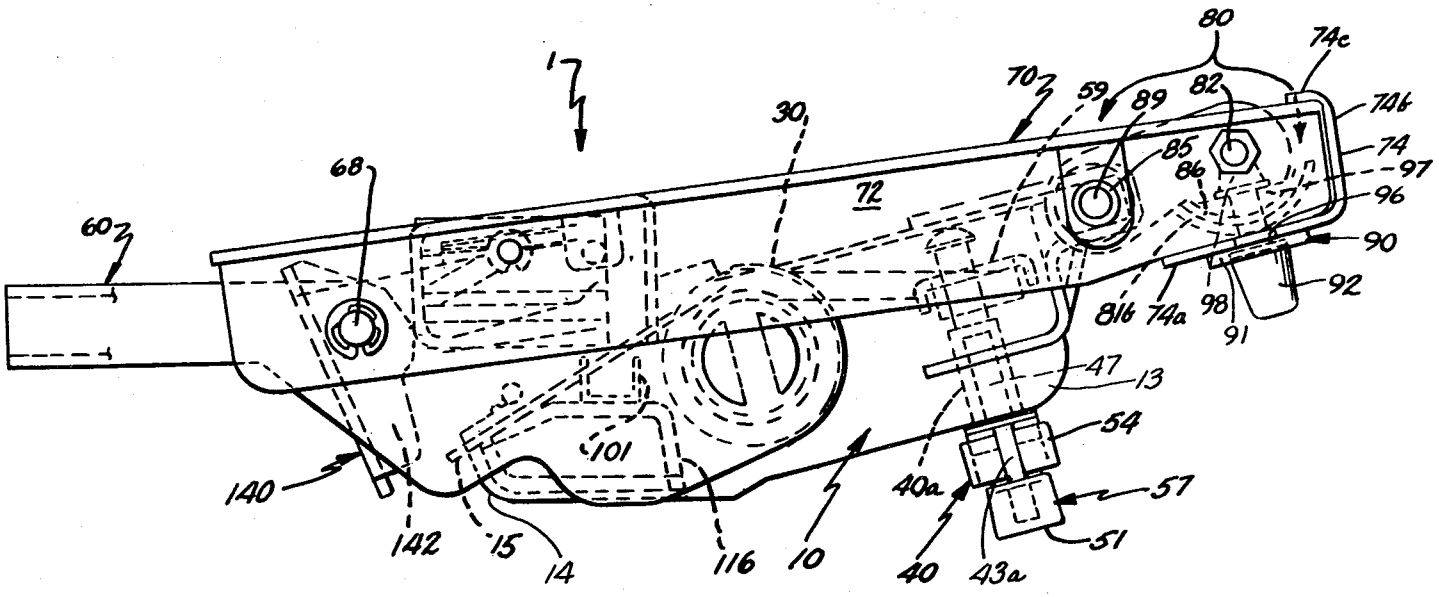
FIG. 4 is a side elevational view of the chair control with some of the internal components being shown in hidden lines.
Figure 5:
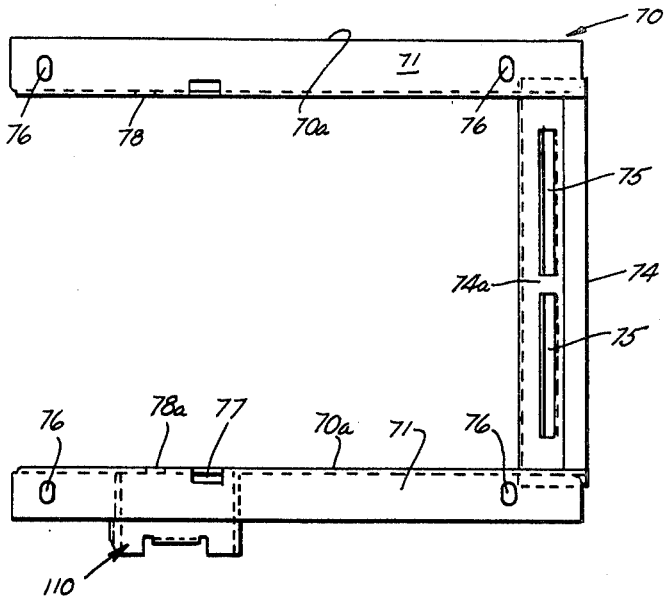
FIG. 5 is a top plan view of the chair seat supporting assembly 70.

Chair control 1 comprises a stationary control housing 10 which houses a bias means 30 (FIGS. 1 and 4). The degree of pretension on bias means 30 is controlled by tension bolt assembly 40. Chair back support arms 60 are secured to the ends of the arbor 31 of bias means 30 and pivot with respect to stationary control housing 10. Chair seat support stretcher assembly 70 is pivotally mounted at its rear directly to back support arms 60. The front of seat support assembly 70 is slidably mounted within tracks 20 on the front of stationary control housing 10. This slidable mount could be direct, but as shown in the preferred embodiment is through a seated adjustment assembly 80. However, this assembly is not part of the invention as claimed herein. It would not be described fully herein but for the fact that it is so intimately involved, in the preferred embodiment as shown herein, in the slideable connection of seat support 70 to tracks 20.

Other desirable features are shown in the drawings and may be referred to briefly herein. However, like the seat adjustment assembly 80, they do not per se form part of the invention claimed herein and hence are not described in detail herein.

Figure 2:
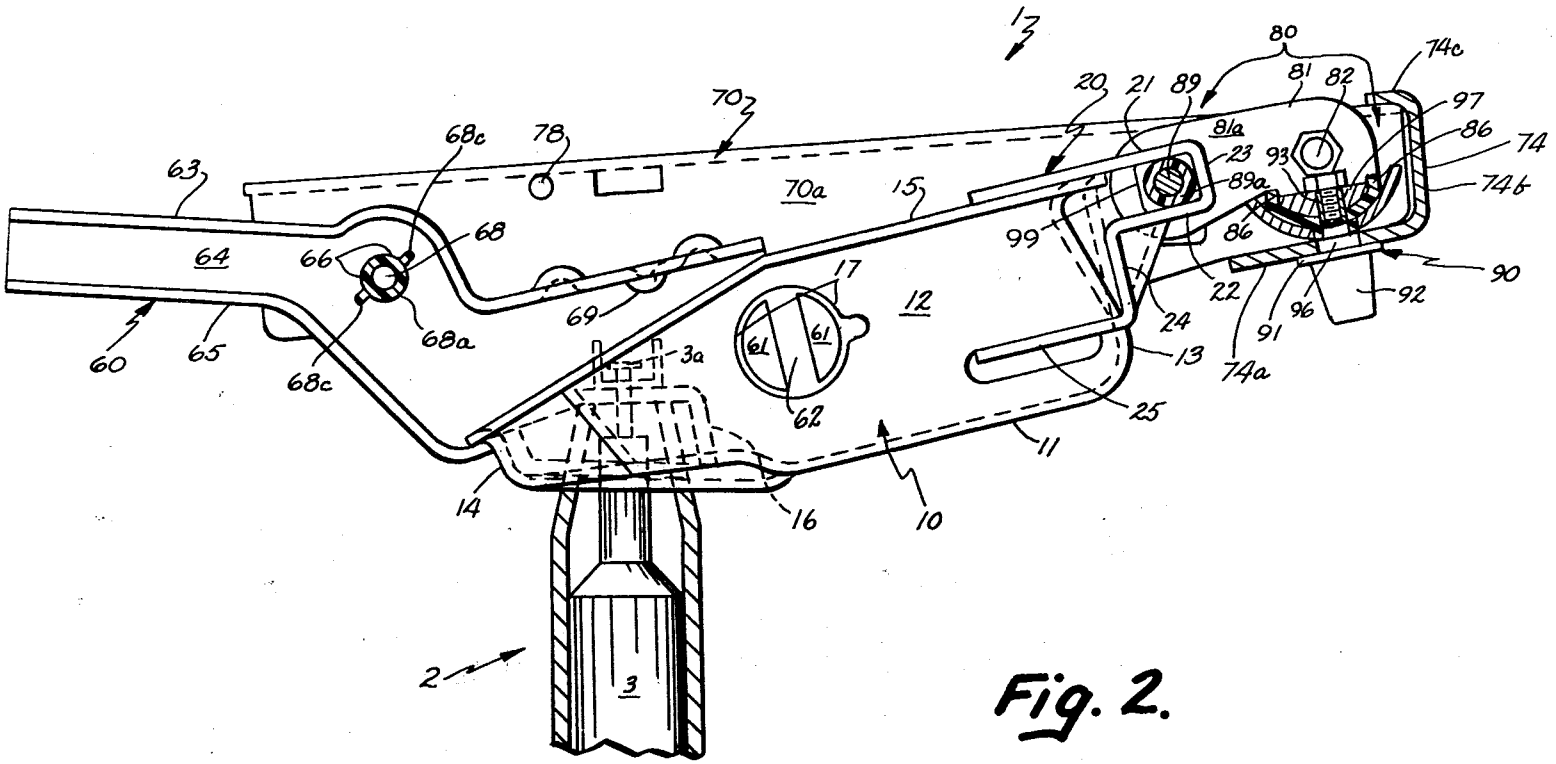
FIG. 2 is a fragmentary cross-sectional view taken generally along planes II—II of FIG. 1, showing only the right side seat support stretcher and back support arm (as viewed in FIG. 1) and eliminating the bias means 30, the tension bolt assembly 40, the pneumatic cylinder adjustment assembly 100, 110, 120 and 130, and eliminating the back upright lock assembly 140, 150 and 160.
Figure 3:
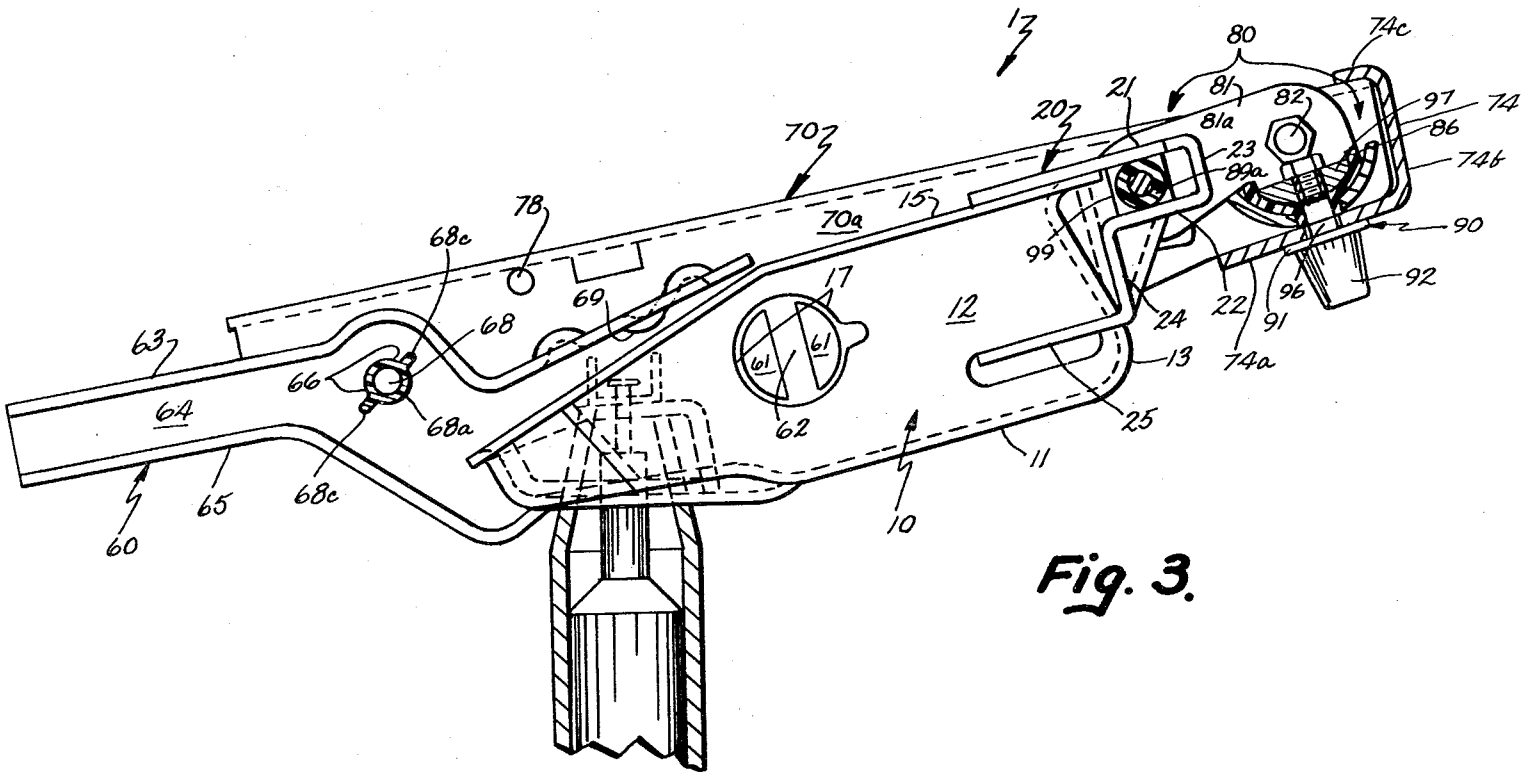
FIG. 3 is the same view as FIG. 2, but with the chair control in the position which it assumes when a person leans back in a chair to which the chair control is attached.

Stationary control housing 10 is a stamped or otherwise formal metal dish having a bottom wall 11, side walls 12, a front wall 13 and rear wall 14 (FIGS. 2 and 3). A lip 15 extends around the upper periphery (see FIG. 2). There is an aperture in bottom 11 through which the upper end of spindle 2 extends. A spindle mounting plate 16 is welded to the inside of housing 10 and includes an aperture 17*a* therein to also receive the upper end of spindle assembly 2 (FIGS. 1 and 2).

Projecting forwardly from front wall 13 are a pair of track brackets 20. These are formed of metal by bending them so as to define a top wall 21, a bottom wall 22 and a front wall 23. These basically define the track in which seat support assembly 70 is slidably mounted. Extending downwardly from bottom wall 22 is a front brace 24 and then bent inwardly from front brace 24 to form the bottom brace 25. The rear portion of top wall 21, front brace 24 and bottom brace 25 are welded to stationary control housing 10 to hold track brackets 20 in place.

Bias means 30 comprises a torsional coil spring arrangement. An arbor 31 which is generally circular in cross sectional configuration extends through holes 17 in side walls 12 of stationary control housing 10 (compare to FIGS. 1 and 2). Arbor 31 is actually hidden in FIG. 1 since it is covered by a plastic sleeve 34. The ends of arbor 31 are rotatably carried in end bearings 35 which are located within side wall holes 17. Coiled around arbor 31 and sleeve 34 are a pair of coil springs 32. The front ends 32*a* of coil springs 32 are captured under retainer nut 59 of tension bolt assembly 40, captured in notches and between the side walls thereof. The rear ends 32*b* of springs 32 are captured under the chair back support arms 60. Tension adjustment is achieved by tightening or loosening tension bolt 40 in retainer nut 59. Tension bolt assembly 40 is itself a unique invention but is not per se a part of the invention claimed herein. Basically, tenion adjustment bolt assembly 40 comprises a bolt 40*a* having a hollow shank normally housing a lever 47. One can grasp gripping cap 51, retract lever 47, pivot it to one side into a slot 43*a* and rotate it to thread bolt 40*a* up or down in retainer 59.

Chair back support arms 60 are formed of metal and are preferably channel shaped in cross section having a top wall 63, a side wall 64 and a bottom wall 65 (FIG. 2). There are two such chair back mounting arms 60, one located on either side of stationary housing 10 (FIG. 1). The generally channel shape cross section allows one to slip a chair back support frame or arm into the channels.

The arbor mounting hole or holes 61 in the side wall 64 of chair back support arm 61 is visible through the hole 17 in the side of stationary housing 10 in FIG. 2. There are two semi-circles 61 spaced by a bridge 62. The ends of arbor 30 are slotted so that they fit into the semi-circles 61. In this way, chair back support arms 60 are fixed against rotation with respect to arbor 30 and as one tilts back in the chair, chair back support arms 60 pivot and arbor 30 rotates within its plastic end bearings 35.

On top wall 63 of each support arm 60, located toward the front thereof are a pair of downwardly projecting dimples or protrusions 69 (FIG. 2). The rear end 32*b* of each coil spring 30 is captured between dimples 69. The other protrusions shown projecting up from top wall 63 are merely reinforcing ribs.

Located about midway along the length of each chair back support arm 60 is a hole 66 which is adapted to receive the rear axle 68 and suitable bearing 68*a*. It is on the rear axle 68 that the rear of chair seat support assembly 70 is pivotally carried.

The chair seat support assembly 70 comprises a pair of spaced stretchers 70*a* joined at the front by front piece 74 (FIGS. 1, 2, 5 and 6). Each side stretcher 70*a* is formed of steel to define a top ledge 71 and a side wall 72. There are mounting holes 76 in top ledges 71 to facilitate mounting chair control 1 to the bottom of a chair seat. Located in one side stretcher 70*a* is a push rod hole 77 through which the push rod 105 of a pneumatic cylinder adjustment assembly 100 extends. There is an aperture 78*a* in the same side stretcher and a similar aperture 78 in the other side stretcher 70*a* through which the chair control lock actuator rod 150 extends.

Located towards the rear of each side wall 72 of each stretcher 70*a* is a rear axle receiving hole 79 (FIG. 6) which receives the end of rear axle 68 carried in a suitable plastic bearing of "T" shaped longitudinal cross section 79*a* (FIG. 1). Of course, suitable retainer clips 79*b* or the like then hold rear axle 68 in position (hidden in FIG. 1).

The front piece 74 which is welded to and thereby joined to side stretchers 70*a* is generally "J" shaped having a bottom wall 74*a*, a front wall 74*b* and a top lip 74*c*. Bottom wall 74*a* includes a pair of spaced slots 75 therein for cooperating with components of seat adjustment assembly 80. One slot is located towards one side stretcher 70*a* and the other slot towards the other.

Figure 6:
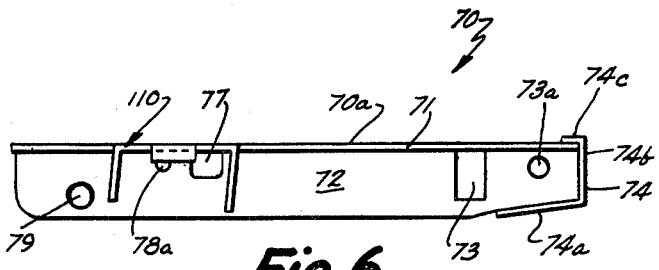
FIG. 6 is a side elevational view thereof.

A large generally rectangular opening 73 is provided towards the front of each side wall 72 of each stretcher 70*a*. (FIGS. 4 and 6). These facilitate sliding of axel 89 in tracks 20 without interference and also facilitate cooperation with seat adjustment assembly 80. The forwardmost holes 73*a* in each side wall 72 of each stretcher 70*a* similarly facilitate mounting of seat adjustment assembly 80 to stretcher assembly 70. The details of this cooperation are set forth more fully hereinbelow.

At this point, it should be noted that chair support stretcher assembly 70 could be slidably mounted directly to front tracks 20 without incorporating seat adjustment assembly 80 in any way. It is so claimed herein. However, seat adjustment assembly 80 is so intimately involved in the slidable interconnection of seat stretcher 70 to tracks 20 that it will be described fully herein.

Seat adjustment assembly 80 comprises first of all a pivot bracket 81 which is pivotally mounted between side stretchers 70*a* of stretcher assembly 70 via pivot nut, bolt and washer assemblies 82 through holes 73*a* (FIGS. 1, 2, 7 and 8). Pivot bracket 81 comprises a pair of spaced, short legs 81*a* joined by a cylindrical bottom wall 81*b*. Cylindrical wall 81*b* defines at least a portion of the wall of a right circular cylinder having its axis of revolution on the pivot axis between bracket 81 and seat support assembly 70. All are formed of metal and are welded together or alternatively formed from a single piece.

Figure 7:
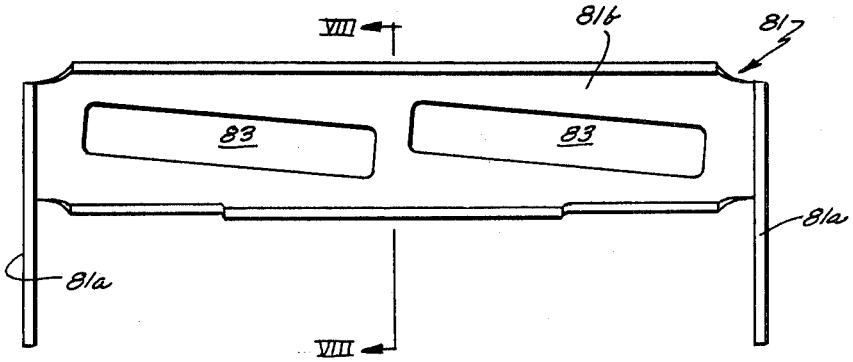
FIG. 7 is a top plan view of the seat adjustment pivot bracket 81.
Figure 8:
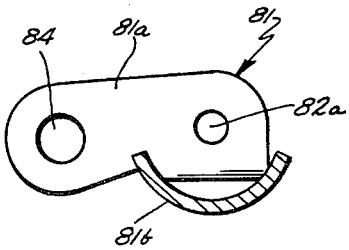
FIG. 8 is a cross-sectional view thereof taken along plane VIII—VIII of FIG. 7.
Figure 9:
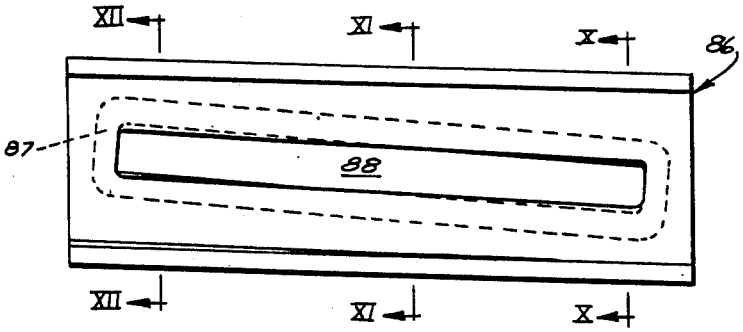
FIG. 9 is a top plan view of the pivot bracket insert 86.
Figure 10:
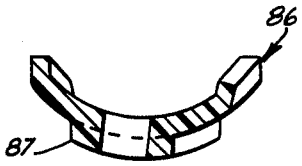
FIG. 10 is a cross-sectional view thereof taken along plane X—X of FIG. 9.
Figure 11:
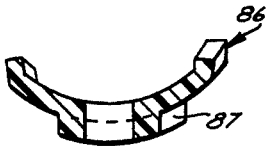
FIG. 11 is a cross-sectional view thereof taken along plane XI—XI of FIG. 9.
Figure 12:
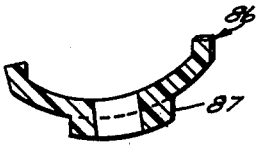
FIG. 12 is a cross-sectional view thereof taken along plane XII—XII of FIG. 9.

The hole 82*a* towards the front of each side wall 81*a* through which the bolt of nut, bolt and washer assembly 82 passes can be seen in FIG. 8. Referring to FIG. 7, it will be seen that there are a pair of spaced slots 83 in bottom wall 81*b* of pivot bracket 81. Each slot 83 is generally spirally or helically oriented in the cylindrical bottom wall 81*b*. When pivot bracket 81 is pivotally secured in position in seat support stretcher assembly 70, helical slots 83 line up above slots 75, with bottom wall 81*b* possibly but not necessarily contacting bottom wall 74*a* on front piece 74 of seat support assembly 70. However, slots 83 are slanted relative to slots 75 such that they overlap only at selected points at any given time.

The particular points at which slots 83 line up with slots 75 is determined by adjustment slide 90 (FIGS. 2, 4, 13 and 14). Adjustment slide 90 comprises a flat bottom plate 91 having a gripper flange 92 projecting downwardly from the bottom thereof. Protruding upwardly from bottom plate 91 are a pair of spaced bolts 93. Bottom plate 91 including gripper 92 is molded of plastic and bolts 93 are square cross section shoulder bolts which are molded in place in the plastic. A raised locating shoulder 96 around each bolt 93 is also integrally molded of the plastic material with plate 91 and gripper 92.

In assembly, bolts 93 project upwardly through slots 75 and 83, with each locating shoulder 96 fitting snuggly within one of said slots 75 in the bottom wall 74*a* of front piece 74 of seat support assembly 70. More specifically, the square cross sectioned shank 95 of each bolt 93 extends upwardly through the slot 88 in a molded plastic pivot bracket insert 86 (FIGS. 9–12 as well as FIGS. 1, 2, and 4). Pivot bracket inserts 86 are made of a self lubricating type of plastic such as a glass reinforced nylon in order to minimize friction in the seat adjustment assembly. It will be noted that each insert 86 is cylindrical in cross sectional configuration so that it seats snuggly against the cylindrical cross sectional configuration of the bottom wall 81*b* of pivot bracket 81. The slot 88 in pivot bracket insert 86 is similarly helical in shape so that it matches with slot 83. It will be further noted that each slot 88 is framed by a peripheral, downwardly projecting lip 87 which actually extends into and through the receiving slot 83. The helical configuration of lip 87 can be appreciated by reference to the three cross sections shown in FIGS. 10, 11 and 12.

Figure 13:
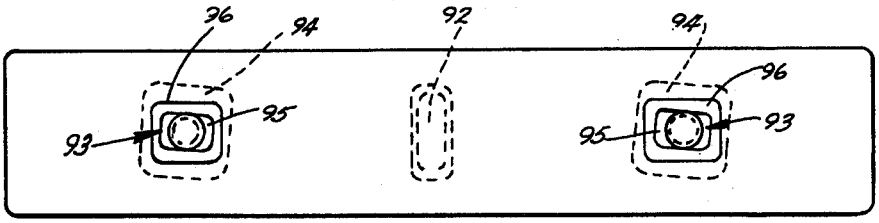
FIG. 13 is a top plan view of the seat adjustment slide 90.
Figure 14:
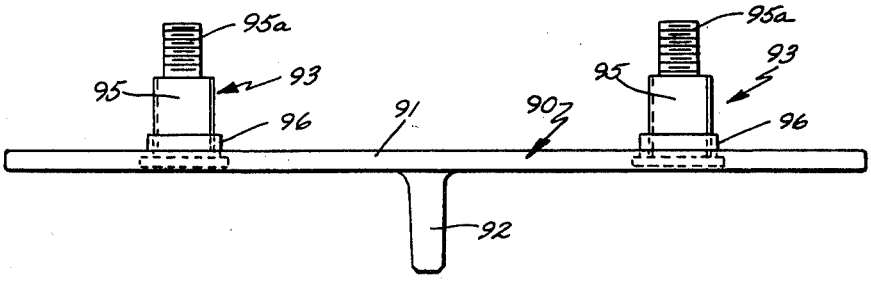
FIG. 14 is a side elevational view thereof.

Because of the difference between the generally rectinlinear slot 75 in seat support front piece 74 as distinguished from the helical slot 88 in pivot bracket inserts 86, it will be noted by reference to FIG. 13 that the plastic guide or locating shoulders 96 at the base of each upwardly projecting bolt 93 are generally rectangular in configuration and are oriented parallel to the longitudinal axis of seat adjustment slide 90. Thus, these locating shoulders 96 sit nicely in slots 75 and slide readily from one end thereof to the other.

However, the generally rectangular shank or shoulder 95 of shoulder bolts 93 are cocked at a slight angle with respect to the longitudinal axis of slide 90. This is accomplished by embedding shoulder bolts 93 at a cocked angle that can be seen from the outline of the heads 94 of the bolts which are embedded in the plastic of bottom plate 91. These cocked, generally rectangular shanks or shoulders 95 then fit readily into slots 88 and slide readily along the length thereof.

Projecting upwardly from the cocked shoulder 95 of bolts 93 are the threaded upper ends 95*a*. Referring to FIGS. 1, 2 and 4, it will be understood that a washer of generally solid semi-cylindrical lateral cross section fits over the threaded portion 95*a* of each bolt 93 and the cylindrical wall portion of each washer 97 seats down in the cylindrical nest defined by pivot bracket inserts 86. Flanged nuts 98 are then threaded down onto threaded ends 95*a* of bolts 93. The components are dimensioned or adjusted such that washer 97 rests on top of shoulder or shank 95 without tightening pivot bracket inserts 86 and pivot bracket 81 too tight against bottom wall 74*a* of seat stretcher front piece 74. This allows one to slide seat adjustment slide 90 to the left or to the right relative to the front of chair control 1, thereby changing that portion of slots 88 and 83 which overlie the longitudinally oriented slots 75 of seat stretcher front piece 74. In effect, this causes pivot bracket 81 to rotate about its pivotal mounting via nut, washer and bolt assemblies 82 to seat stretcher assembly 70. Such rotation shifts the elevation of the left end of each leg 81*a* of pivot bracket 81 with respect to the side stretchers 70*a* of seat stretcher assembly 70.

The purpose of this change in elevation is to change the effective angle or elevation of the front of a chair seat mounted on chair control 1. Located at the left end as viewed in FIGS. 2, 4 and 8, of pivot bracket 81 is an axle receiving hole 84. A front slide axle 89 extends through the axle receiving holes 84 in the opposite pivot bracket legs 81*a*. The ends of the axle 89 are carried in suitable bearings 89*a*.

Axle 89 passes through the lateral openings in track brackets 20 at the front of stationary control housing 10 whereby pivot bracket 81 is pivotally mounted to stationary housing 10. Within the confines of each track bracket 20, axle 89 is carried in a plastic bushing 99 of generally rectangular cross section (FIGS. 1 and 2). Retainer clips or rings 99*a* (FIGS. 1) hold the plastic bushing 99 and the axle 89 in position within track bracket 99. With the ends of pivot bracket legs 81*a* thus assembled to the front of stationary control housing 10, the pivoting of pivot bracket 81 by changing the position of slide 90 thereby changes the elevation of the front of seat support assembly 70 with respect to the front of stationary control housing 10. This then facilitates adjustment of the seat angle by the user of the chair to which chair control 1 is mounted.

Bushings 99 are preferably formed of a self lubricating plastic material of the type commonly used to minimize friction. An example of such a plastic would be the acetal type, available from Dupont as "DELRIN" TM and from Celenese is "CELCON" TM. This enables bushings 99 to slide along the length of track brackets 20.

Such sliding action takes place when the user of a chair to which chair control 1 is mounted leans back in the chair. In leaning back, he causes chair back support arms 90 to pivot about their pivot point with respec to stationary housing 10. Similarly, chair seat support assembly 70 tilts rearwardly since it is pivotally connected directly to back support arms 60 at axle 68. At the same time, front axle 89 and bushings 99 slide rearwardly within track brackets 20. The enlarged openings 73 in the side stretchers 70*a* allow clearance for the ends of axle 89 to move up and down and slide. A comparison of chair control 1 in its untitled and tilted back positions respectively can be seen by comparing FIGS. 2 and 3.

Also, the sliding interconnection between stationary member 10 and pivot axle 89 allows pivot axle 89 to shift as pivot bracket 81 is rotated. At some point, there has to be means allowing at least one connection between said housing 10 to shift vis-a-vis seat support 70 when pivot bracket 81 is rotated.

OPERATION

With the various assemblies, sub assemblies and components thus described, the operation of chair control 1 can be more fully appreciated. As a person leans back in a chair to which chair control 1 is assembled, the chair back support arms 60 begin to pivot about their pivotal mounting (on arbor 31) to stationary housing 10. At the same time the rear of seat support stretcher assembly 70 begins to shift downwardly relative to its front since chair seat support stretcher assembly 70 is pivotally joined to back support arms 60 by rear axle 68. The front of seat support assembly 70 pivots about front axle 89 which, along with its bushings 99, slides rearwardly in tracks 20. FIGS. 2 and 3 illustrate chair control 1 in its untilted and fully tilted conditions respectively.

The various pivot points are located such that the chair back tilts rearwardly at a rate which is approximately twice as fast as the rate of tilt for the seat. Because the seat support 70 is pivotally connected directly to the back support arms 60 rather than through some sort of toggel linkage or slide, there is less sensation of the seat and back separating as one tilts rearwardly. Further, wear and tear are minimized since the only movement between the seat support 70 and back support 60 is a pivotal movement about suitable bearings. The loads imposed on the sliding bushings 99 are relatively minimal compared to the loads imposed on rear axle 68. That is because as one tips rearwardly in the chair, one tends to shift his weight to the rear of the chair and off from the front of the chair seat. As a result, there is little likelihood of bushings 99 getting hung up in track 20 or of wearing out before they have enjoyed a suitable life span.

Of course, it is understood that the above is merely a preferred embodiment of the invention and that various changes and alterations can be made without departing from the spirit and broader aspects thereof as more particularly defined in the appended claims.

The embodiments of the present invention in which an exclusive property or privilege is claimed are defined as follows.

1. In a synchrotilt chair control having a stationary control housing, resilient biasing means mounted in said stationary control housing, chair back support means pivotally mounted on said stationary control housing and operably interconnected with said resilient biasing means, and chair seat support means mounted on said stationary control housing and operably connected to said chair back support means for rearwardly tilting with said chair back support means, but at a different rate with respect thereto, against the biasing action of said resilient biasing means in response to a person leaning back in a chair to which said control is mounted, the improvement comprising: said chair seat support means having a forward portion located towards the front of a seat of a chair, when said control is mounted on a chair, and having a rearward portion located towards the rear of such a chair seat; said rearward portion of said chair seat support means being pivotally connected directly to said chair back support means; said stationary housing including track means located towards the front thereof; said seat support means being slidably mounted in said track means at said forward portions of said seat support means, whereby said seat support means is free to shift relative to said stationary housing when a user tilts rearwardly in a chair mounted on such chair control yet whereby wear and tear on moving components is minimized by reason of said slidable interconnection between said chair seat support means and said stationary housing being located towards the front of said chair seat support means.

2. The chair control of claim 1 in which said track means comprise; a pair of spaced track brackets mounted on the front of said stationary control housing and projecting forwardly therefrom, each said track bracket comprising a flat top wall and a flat bottom wall joined by a front wall; said chair seat support means being operably connected to bushings which are slidably located between said top and bottom walls of said track brackets, such that said bushings slide in said track brackets.

3. The chair control of claim 1 or 2 comprising: said stationary control housing having spaced side walls; said resilient bias means comprising a torsion means extending between said spaced side walls of said stationary control housing and having portions extending through and beyond said side walls, said extending portions being generally in alignment with the torsional axis of said torsion means; said chair back support means being mounted on said extending portions of torsion means so as to pivot about said torsional axis.

4. The chair control of claim 3 comprising: said stationary member being generally dish shaped in configuration with said resilient biasing means being mounted within said dish and thereby generally concealed from view.

5. The chair control of claim 4 in which said chair back support means comprises a separate lever arm mounted on either side of and to the outside of said stationary control housing.

6. The chair control of claim 5 in which said seat support means comprises a pair of spaced stretchers mounted to the outside of said back support means and said stationary control housing.

7. The chair control of claim 1 comprising; said stationary member being generally dish shaped in configuration with said resilient biasing means being mounted within said dish and thereby generally concealed from view.

8. The chair control of claim 1 or 7 in which said chair back support means comprises a separate lever arm mounted on either side of and to the outside of said stationary control housing.

9. The chair control of claim 8 in which said seat support means comprises a pair of spaced stretchers mounted to the outside of said back support means and said stationary control housing.

* * * * *

UNITED STATES PATENT AND TRADEMARK OFFICE

CERTIFICATE OF CORRECTION

PATENT NO. : 4,314,728

DATED : February 9, 1982

INVENTOR(S) : Frederick S. Faiks

It is certified that error appears in the above—identified patent and that said Letters Patent is hereby corrected as shown below:

Abstract, line 2:

"toggel" should be --toggle--

Column 1, line 34:

"toggel" should be --toggle--

Column 1, line 52:

"toggel" should be --toggle--

Column 2, line 19:

"toggel" should be --toggle--

Column 4, line 7:

"tenion" should be --tension--

Column 5, line 3:

"axel" should be --axle--

UNITED STATES PATENT AND TRADEMARK OFFICE

CERTIFICATE OF CORRECTION

PATENT NO. : 4,314,728

DATED : February 9, 1982

INVENTOR(S) : Fredrick S. Faiks

It is certified that error appears in the above—identified patent and that said Letters Patent is hereby corrected as shown below:

Column 5, line 40:

"on" should be --of--

Column 5, line 58:

"snuggly" should be --snugly--

Column 5, line 68:

"snuggly" should be --snugly--

Column 6, line 65:

"Figs. 1" should be --Fig. 1--

Column 7, line 17:

"respec" should be --respect--

Column 7, line 25:

"untitled" should be --untilted--

Column 7, line 35:

"sub assemblies" should be --subassemblies--

Column 7, line 54:

"toggel" should be --toggle--

UNITED STATES PATENT AND TRADEMARK OFFICE

CERTIFICATE OF CORRECTION

PATENT NO. : 4,314,728

DATED : February 9, 1982

INVENTOR(S) : Fredrick S. Faiks

It is certified that error appears in the above—identified patent and that said Letters Patent is hereby corrected as shown below:

Column 8, Claim 2, line 39:

";" should be --:--

Column 9, Claim 7, line 3:

";" should be --:--

Signed and Sealed this

*Seventh* Day of *September 1982*

[SEAL]

*Attest:*

GERALD J. MOSSINGHOFF

*Attesting Officer*

*Commissioner of Patents and Trademarks*